US006340022B1

(12) United States Patent
Schroer

(10) Patent No.: US 6,340,022 B1
(45) Date of Patent: Jan. 22, 2002

(54) BLADE AND ARBOR ADAPTOR FOR CIRCULAR SAW

(76) Inventor: Daniel J. Schroer, 6127 Kenwood, Kansas City, MO (US) 64110

( * ) Notice: Subject to any disclaimer, the term of this patent is extended or adjusted under 35 U.S.C. 154(b) by 0 days.

(21) Appl. No.: 09/411,438

(22) Filed: Oct. 1, 1999

(51) Int. Cl.[7] ..... B24B 23/00; B28D 1/04
(52) U.S. Cl. ..... 125/13.01; 125/12; 451/342
(58) Field of Search ..... 125/12, 13.01, 125/15; 451/342, 343

(56) References Cited

U.S. PATENT DOCUMENTS

| | | | | |
|---|---|---|---|---|
| 3,656,393 | A | * | 4/1972 | Goellner |
| 4,015,371 | A | * | 4/1977 | Grayston |
| 4,240,230 | A | * | 12/1980 | Ferrantini |
| 4,541,205 | A | * | 9/1985 | Patrello |
| 4,769,201 | A | | 9/1988 | Chiuminatta et al. |
| 4,889,675 | A | | 12/1989 | Chiuminatta et al. |
| 4,928,662 | A | | 5/1990 | Chiuminatta et al. |
| 4,938,201 | A | | 7/1990 | Chiuminatta et al. |
| 5,054,699 | A | | 10/1991 | DeJaynes |
| 5,086,750 | A | | 2/1992 | Chiuminatta et al. |
| 5,184,597 | A | | 2/1993 | Chiuminatta et al. |
| 5,303,688 | A | | 4/1994 | Chiuminatta et al. |
| 5,305,729 | A | | 4/1994 | Chiuminatta et al. |
| 5,373,834 | A | | 12/1994 | Chiuminatta et al. |
| 5,441,033 | A | | 8/1995 | Chiuminatta et al. |
| 5,505,189 | A | | 4/1996 | Chiuminatta et al. |
| 5,507,273 | A | | 4/1996 | Chiuminatta et al. |
| 6,042,461 | A | * | 3/2000 | Pearson ..... 451/359 |

OTHER PUBLICATIONS

Soft–Cut International—"The System That Controls Random Cracking in Concrete" brochure (12 pgs.) 03346/SOF—Buyline 7354 (1996).

* cited by examiner

*Primary Examiner*—Timothy V. Eley
(74) *Attorney, Agent, or Firm*—Hovey, Williams, Timmons & Collins

(57) ABSTRACT

A circular saw having a driven shaft and mounting a blade-receiving arbor are adapted to carry a blade having a circular inner margin by the use of an arbor adaptor. The arbor adaptor is provided with a central aperture and a first engagement side having a central recess and a blade positioning ring. The central recess is sized and positioned to receive a mounting lug of the arbor therein with the blade positioning ring in radially surrounding relationship, the blade being received on the ring. A friction surface on the arbor adaptor serves to frictionally clamp the blade to the arbor. In some embodiments, a drive pin may be provided on the adaptor to fit within a complemental hole in the blade for rotatably driving the blade. A second engagement side opposite the first engagement side may be provided for using the arbor adaptor with a second, different saw. The aperture for mounting the arbor adaptor may be offset relative to the axis of rotation of the adaptor ring which is preferably equidistant from the circular outer margin, so as to mount onto a stud or mounting bolt which is inserted into a bore of the shaft or arbor and offset relative to the axis of rotation of the shaft and arbor, to thereby maintain circular, non-eccentric rotation of the blade.

26 Claims, 4 Drawing Sheets

BLADE AND ARBOR ADAPTOR FOR CIRCULAR SAW

BACKGROUND OF THE INVENTION

1. Field of the Invention

This invention concerns shaft drive circular blade saws. More particularly, it concerns blades and arbor adaptors for use on different saws with specialized configuration blade mounting arbors.

2. Description of the Prior Art

Circular saws as used herein are those saws having a power source such as an electric or pneumatic motor or gasoline engine which, through a shaft, rotate a generally planar circular blade to cut a kerf. The circular saws may be hand held or mounted on a wheeled carriage or the like, and may cut wood, metal, masonry or other materials. To that end, a number of different saws have been developed which are particularly adapted to for cutting different materials, and blades have been designed for a particular type of cut to be made. For example, smaller hand-held saws have been developed for trim carpentry or metalworking use, larger saws for framing carpentry, and still larger saws mounted on wheeled carriages for use in cutting concrete. The blades for these applications are very different, with tooth patterns varying for metalworking on different metals, cross-cut and rip-cutting of different woods, and abrasive tipped and different toothed blades for cutting concrete or other masonry.

Such circular saws may mount the blade to the shaft by use of an arbor. The motor or other power source turns the shaft and the arbor is rotatably coupled to the shaft. The blade then mounts on the arbor and is held in place by a retaining bolt threadably received in the arbor. A saw may be developed with an arbor having a blade mount with a specific configuration rather than a conventional round mount, e.g. square, diamond-shaped, triangular, etc. In such circumstances, the blade must be configured to with an opening which matches the mount. One approach to this problem in the past has been to provide a blade with has a central round opening common to many saws and a frangible insert which may be removed to permit mounting on a particular saw. While this has been useful in some circumstances, it does not provide for use with arbors having blade mounts of yet further different configurations. Moreover, in heavy duty applications, it risks weakening the blade when the opening for the removable insert has sharp corners. In addition, some larger blades require additional support to provide sufficient torque transmission to avoid blade slippage.

Some prior art saws have employed an arbor or shaft which includes a threaded stud which is threadably received in the arbor or shaft and displaced from the axis of rotation so as to be off-center. This in turn has required a saw blade which has a mounting hole similarly displaced from the center of the saw blade in order to be usable and function by rotating without oscillating. Such an arrangement severely limits the availability of different blades which may be used with the saw when so configured and leads to increased costs of operation.

There has thus arisen a need for a simple and rugged arbor adaptor which permits the use of non-specific saw blades with several circular saws, yet provides sufficient support and strength.

SUMMARY OF THE INVENTION

These needs have largely been met by the arbor adaptor and circular saw blade of the present invention. That is to say, the present invention enables the use of a saw blade having a central opening able to mount on an arbor or shaft of circular saws of multiple different applications. As a result, a common and simple saw blade configuration can be used with saws have particular shaped arbors without the necessity of making specialized and custom blades.

The arbor adaptor hereof broadly includes a central aperture and a first engagement side, the first engagement side including a central recess for receiving a non-circular mounting lug of an arbor therein. The first engagement side further includes an annular blade-locating ring which extends normally from the central recess and is configured to radially surround the mounting lug and in turn to receive thereon in radially surrounding relationship the inner margin of the blade which is preferably complementally sized with the outer rim of the blade locating ring. A friction surface is provided radially outwardly of the blade locating ring for clamping the blade to the arbor.

In some embodiments, a second engagement side may be provided for mounting a blade to a second arbor having a differently sized or configured mounting lug, or no mounting lug. The second engagement side includes a second central recess having a different diameter than the central recess of the first engagement side, and a second friction surface. The second friction surface may have a different radially size or dimension than the friction surface on the first side, or the same dimension.

In other embodiments, particularly those where larger diameter blades having greater drive requirements are used, the arbor adaptor may be provided with a drive pin, and the central recess may be defined by an irregular inner rim on the blade locating ring to provide engagement points for contacting the mounting lug. The blade is provided with a complemental drive hole for receiving the drive pin therein, with the mounting lug engaging at least one and preferably at least two engagement points for rotatably driving the arbor adaptor, which throughout the pin and the frictional clamping relationship drives the blade.

A further embodiment of the foregoing invention utilizes an arbor adapter for mounting on saws having an arbor or shaft with an offset stud or a central bore receiving another threaded fastener, thereby enabling the use of a saw blade with an axially centered mounting opening, such as a preferably generally circular inner margin. The arbor adaptor has a central aperture which is offset from the axis of rotation the same displacement as the stud, and has a blade positioning ring which is, as above, centered on the axis of rotation. The outer margin of the arbor adaptor may be generally circular as described above, so that during rotation, the arbor adaptor and blade rotate about the axis of rotation, rather than have an eccentric pattern of motion. Thus, the rotation of the stud, offset to the axis of rotation, causes the central aperture of the arbor adaptor to rotate about the axis of rotation, but the arbor adaptor itself and the blade carried thereby rotate substantially without eccentricity. The weight of the arbor adaptor is generally sufficient to compensate for the slight offset to the central opening. If the stud is provided with a flat side or other change in shape, the central aperture may be provided with a complimentary shape.

These and other advantages will be readily appreciated by those skilled in the art with reference to the following description of the preferred embodiments.

DESCRIPTION OF THE PREFERRED EMBODIMENT

Figure 1:
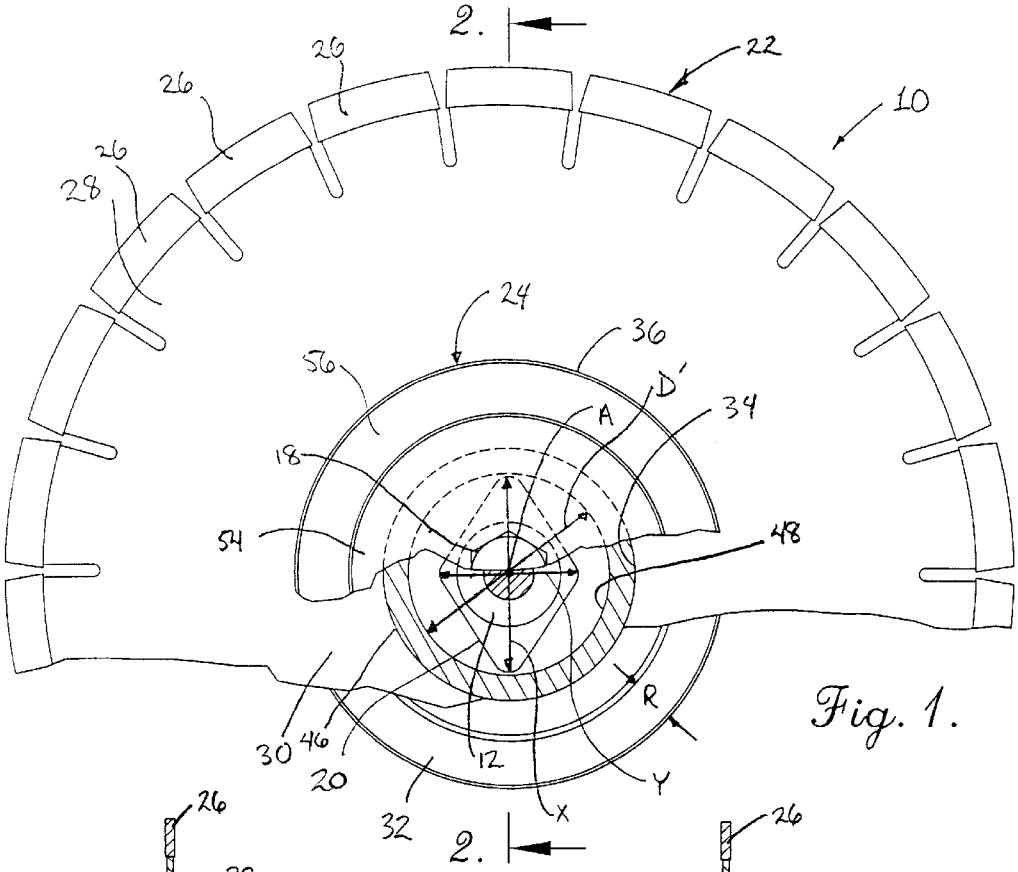
FIG. 1 is a fragmentary side elevational view of a circular saw blade and arbor adaptor of the present invention, showing the blade and adaptor coupled to a circular saw arbor having a diamond-shaped blade mount.
Figure 2:
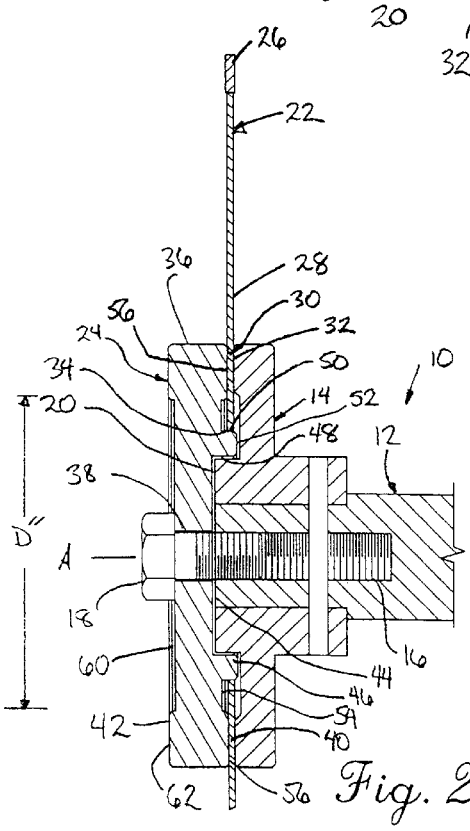
FIG. 2 is a fragmentary vertical cross-sectional view taken along line 2—2 of FIG. 1, showing the adaptor in a first position for frictionally holding the blade onto the arbor.
Figure 3:
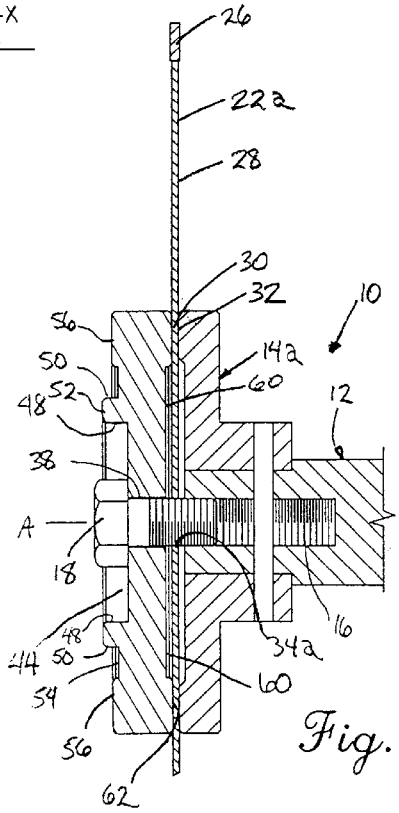
FIG. 3 is a fragmentary vertical cross-sectional view similar to FIG. 2 but showing the adaptor in a second, reversed position for frictionally holding the blade to a different arbor.

Referring now to the drawing, a circular saw 10 includes a shaft 12 driven by a power source such as an electric motor or the like and for rotation therewith about an axis a. The shaft 12 is also coupled to an arbor 14. The arbor 14 has an internally threaded central bore 16 for receiving a retaining bolt or other fastener 18, and includes a mounting lug 20. As shown in FIGS. 1 through 3, the mounting lug 20 is diamond shaped presenting a major axis X and a minor axis Y, but as discussed above and below, the mounting surface provided by the arbor manufacturer may be of other shapes as well. The foregoing, elements are conventional and well known in the art.

A blade 22 and an arbor adaptor 24 are provided in accordance with the present invention for mounting to the arbor 14 by the retaining bolt 18. The blade 22 is shown having a plurality of teeth 26 configured for cutting wet, semi-hardened concrete, but may be an abrasive disk or have teeth of different common configurations and sizes for different purposes such as cutting metal or wood. Flat and planar side panel 28 extends radially inwardly from the teeth 26. The side panel 28 includes generally annular friction band 30 which is located radially inward of the teeth 26. The friction band 30 is preferably of a radial dimension sufficient to engage the annular friction ring 32 of several alternative arbors so that it can be used with saws of different manufacturers. The blade 22 has a central opening for mounting onto the arbor and arbor adaptor 24, shown defined by a centered circular inner margin 34 in side panel 28, so that when rotated at high speed, the blade 22 is preferably statically and dynamically balanced.

The arbor adaptor 24 shown in FIGS. 1 through 3 is preferably a disk having an outer margin 36, an unthreaded central aperture 38 for receiving the retaining bolt 18 therethrough, a first engagement side 40 and a second engagement side 42, and as a result is adapted for use with two or more different arbors. First engagement side includes a central recess 44 and a blade positioning ring 46 radially outward therefrom. The blade positioning ring 46 includes a inner rim 48, an outer rim 50 and a rim wall 52. The inner rim 48 is preferably spaced sufficiently radially outward from the central aperture 24 and has a diameter D' to receive most mounting lugs 20 radially inwardly thereof and within the central recess 44. An outer relief recess 54 is located radially outboard of the outer rim 50, and is shallower than the depth of central recess 44. That is to say, the central recess 44 is more proximate the second engagement side 42 than the outer relief recess 54. The inner rim 48 and outer rim 50 extend sufficiently normally from the annular outer relief recess 54 to permit the inner margin 34 of the blade to engage the outer rim 50 as shown in FIG. 2. An annular friction surface 56 is located radially outwardly of relief recess 54 and inwardly of outer margin, and is spaced sufficiently from central aperture 38 to provide good torque transmission to the blade 22, and is preferably located in opposition to the friction surface 32 so as to clamp the friction band 30 therebetween. The location of friction surface 56 provides good tightening characteristics with friction ring 32, each having a radial dimension R and each being radially outward of the relief recess 54 and just inward of the outer margin 36, thereby giving better torque transmission than if located radially inward adjacent the central aperture 38.

The annular outer relief recess 54 is depressed relative to the friction surface 56 so as to avoid warping of the blade 22 as the temperature of the latter rises during use. This also helps reduce the possibility that a bur or debris will be located in engagement between the blade 22 and the arbor 14 or adaptor and result in insufficient torque transmission. Similarly, the central recess 44 is relieved relative to both the positioning ring 46 and the friction surface 56 to avoid the arbor adaptor 24 from "bottoming out" if the central recess 44 were to come into engagement with the mounting surface 20. Preferably, the positioning ring projects normally from the relief recess 54 more than the friction ring 32 only about the thickness of the saw blade 22 to avoid the relief recess 54 engaging the arbor 14. The friction surface 56 preferably has a radial dimension about equal to the friction ring 32 to avoid warping of the blade 22.

The second engagement side 42 is useful in coupling either the blade 22 or an alternate blade **22*a* having a smaller circular inner margin 34*a* to a different second arbor 14*a* which does not have a mounting lug, or merely one with a common, circular mounting for receiving the retaining bolt. In addition, the configuration of the second engagement side 42 permits the use of a blade which has a circular inner margin which is configured complementally with the mounting lug 20, i.e. a blade that has a diamond shaped inner margin in the embodiment shown in FIG. 1. The second engagement side includes a second substantially circular recess area 60 having a transverse diameter D", the second circular recess extending radially outward from the central aperture 38 and a second friction surface 62 similar to but oriented opposite the first friction ring 56 as shown in FIGS. 2 and 3. The second friction surface 62 can extend any desired distance normal to the recessed area 60, but preferably at least about the width of the blade to provide sufficient clearance for any material that might collect therein. The second friction surface 62 also is preferably of a radial dimension and spaced radially from the axis of rotation a of the shaft 12, blade 22 and arbor adaptor 24 so as to be opposed to the friction surface 32 of the arbor 14**.

As may be seen in FIGS. 1 and 2, when the blade 22 is mounted to arbor 14 with the first engagement side 40 oriented toward the arbor 14, the inner margin 34 is spaced from the mounting lug 20 so that the blade 22 is not engaged or driven by the lug 20. The blade 22 thus avoids the necessity of conforming to any particular configuration of the mounting lug 20. Instead, the arbor adaptor 24, which also has its blade positioning ring 46 positioned outward of the mounting lug 20, drives the blade 22 by frictional engagement of the friction band 30 between the friction ring 32 of the arbor 14 and the friction surface 56 of the arbor adaptor 24. Advantageously, the adaptor 24 is reversible, whereby the second engagement side 42 is oriented toward the arbor 14 and shown in FIG. 3 holding blade 22*a*. The blade 22*a*, shown with a smaller diameter circular inner margin 34*a*, is sized complementally with the central aperture and retaining bolt 18 for mounting on a second arbor 14*a* without a mounting lug 20 as shown in FIG. 3, but blades having larger sizes of central apertures may be accommodated. Advantageously, the second engagement side 42 is also configured so that a blade having an inner margin which conforms to the mounting lug 20 may be used with the adaptor 24, thus permitting the adaptor 24 to be used with blades having a circular inner margin 34 generic to different mounting lugs 20 as well as blades having an inner margin specific to a particular shape and size of mounting lug 20 simply by selecting either the first or second engagement side for orientation toward the arbor 14.

Figure 5:
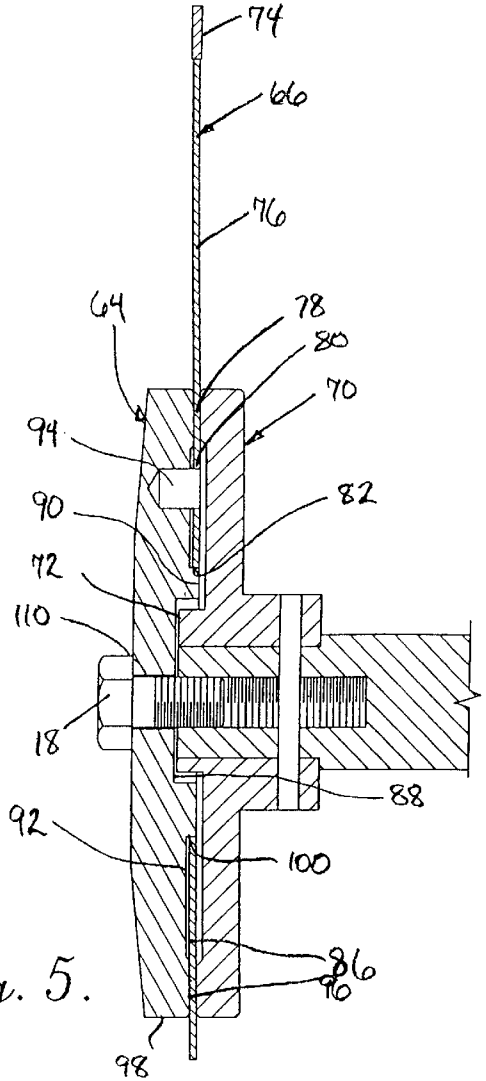
FIG. 5 is a fragmentary vertical cross sectional view taken along FIG. 5—5 of FIG. 4, showing the second embodiment of the arbor adaptor in driven engagement with the triangular shaped mount of the arbor and a drive pin for providing additional torque to the blade.
Figure 4:
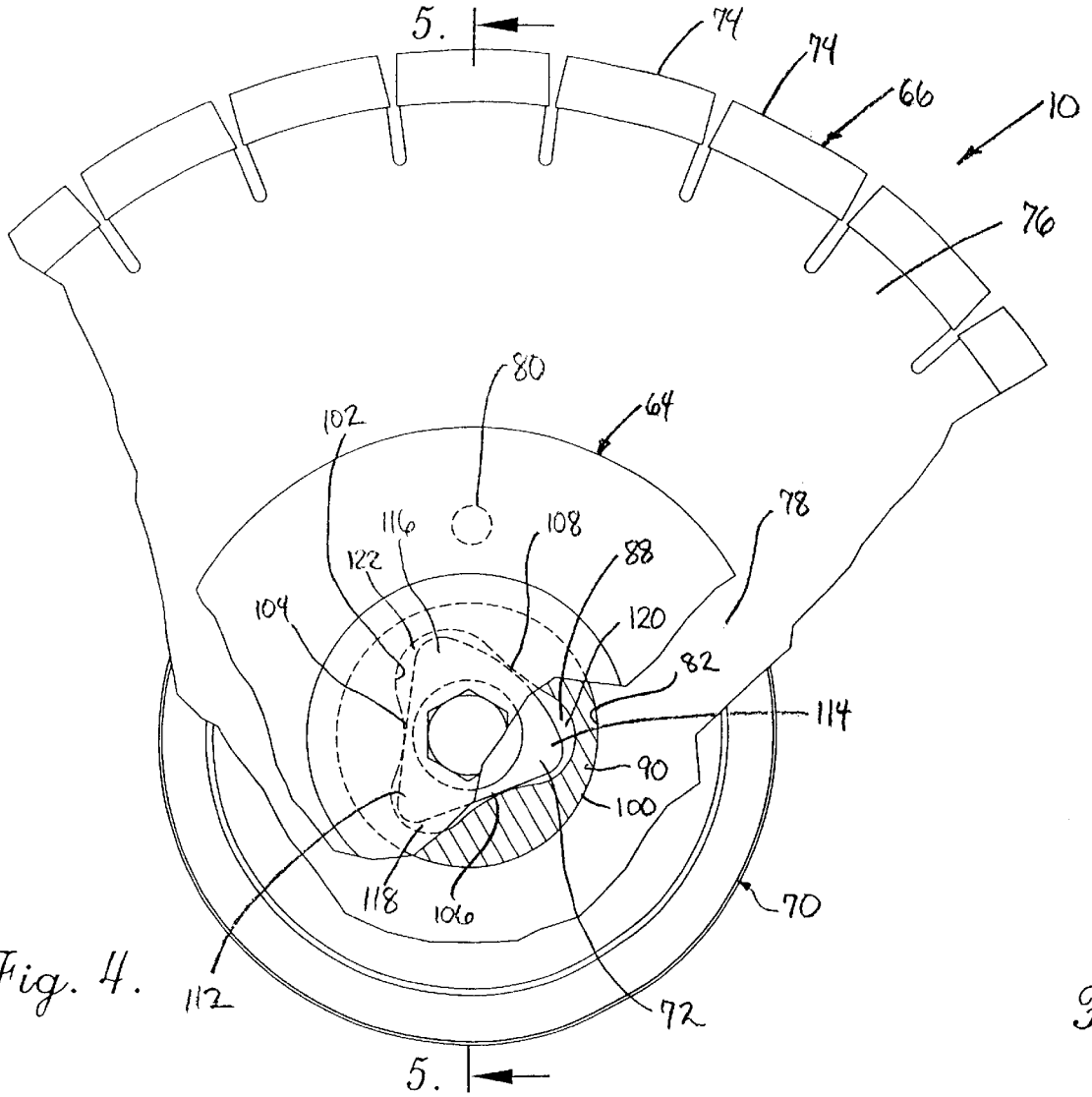
FIG. 4 is a fragmentary side elevational view of a second embodiment of the arbor adaptor and blade hereof, shown mounted to an arbor having a triangular shaped arbor mount.

FIGS. 4 and 5 illustrate a second embodiment of the saw 10 of the present invention, including arbor adaptor 64 and blade 66 for use where greater torque must be transmitted by the shaft 68 through the arbor 70 to drive the blade. The need for greater torque may arise from, for example, a blade 66 having an increased outer diameter. The arbor 70 includes a mounting lug 72, shown as having a generally triangular shape with three lobes in elevation in FIG. 4.

Blade 66 has a plurality of circumferentially spaced teeth 74, a side panel 76 including a friction band 78 and a drive hole 80, and a circular inner margin 82. The friction band 78 is preferably spaced radially inward from the outer edge 84 of the teeth 74 and radially outwardly from the inner margin 82. The drive hole 80 is either within, or as shown in FIGS. 4 and 5, slightly radially inward of the friction band 78.

Arbor adaptor 64 is shown having only a single engagement side 86, although it is to be understood that it also could be provided with a second engagement side 42 of the same configuration as shown in FIGS. 2 and 3. The side 86 of arbor adaptor 64 includes a locating recess 88 within a driven hub 90, an outer recess 92, a drive pin 94, and a friction surface 96. The friction surface 96 is located radially between an outer margin 98 and the outer recess 92 and extends substantially normal to the outer recess 92. The drive pin 94 is received in a cavity 99 in the outer recess 92. The driven hub 90 includes an outer rim 100 which extends substantially normal to the outer recess 92 a sufficient distance more than the friction surface 96 to permit the circular inner margin 82 of the blade 62 to be received thereon in mating relationship as shown in FIGS. 4 and 5.

The driven hub 90 includes an inner rim 102 which is proximate to at least one and preferably three engagement points 104, 106 and 108 by the mounting lug 72. The engagement points 104, 106 and 108 enable greater ease in precisely locating the arbor adaptor 64 than requiring precision machining of the central aperture 110 to mate with a retaining bolt 18. The closer the fit between the engagement points 104, 106 and 108 and the mounting lug 72, the more precise the centering of the arbor adaptor 64 during mounting to the arbor 70, and the less wear on the mounting lug 72 and driven hub 90 when a load is applied to the blade 66 during cutting. When the mounting lug 72 includes multiple lobes 12, 114 and 116 as shown in FIG. 4, the inner rim 102 of the driven hub 90 is configured to receive the lobes in corresponding receiving areas 118, 120 and 122, with the engagement points 104, 106 and 108 intermediate the receiving areas 118, 120 and 122.

Figure 6:
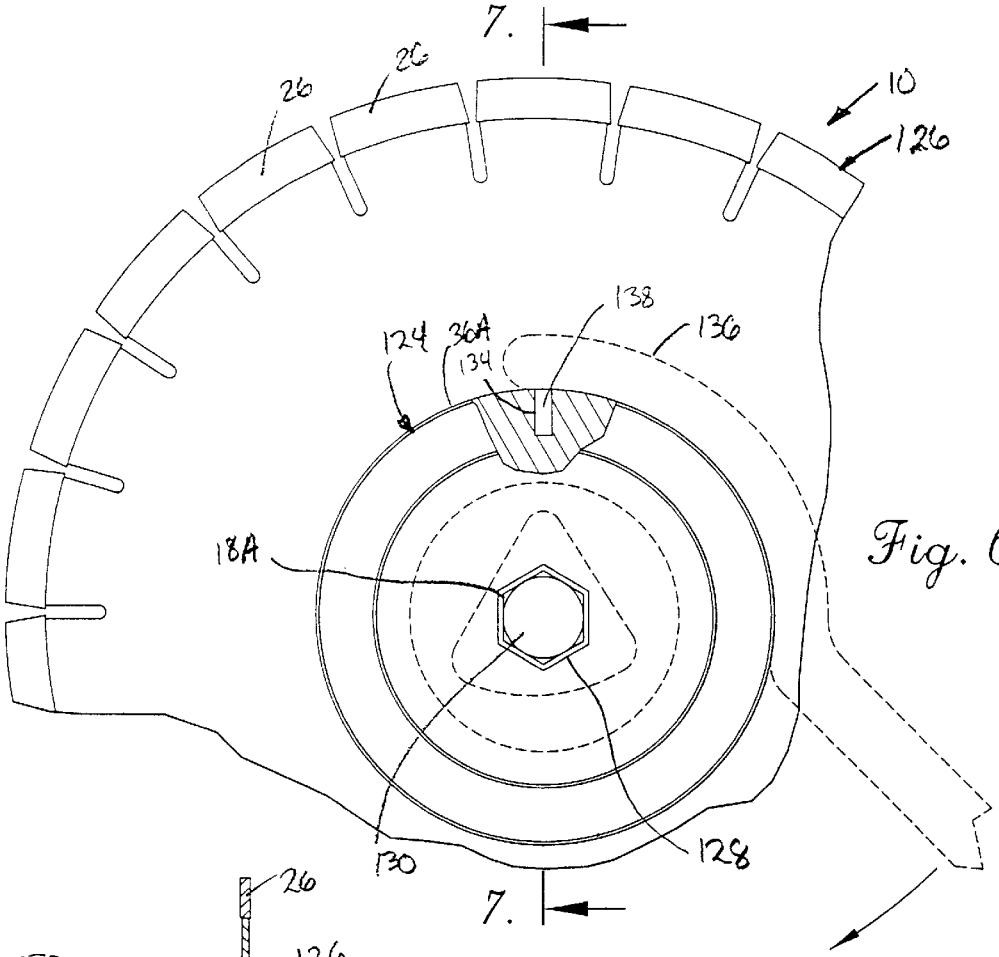
FIG. 6 is a fragmentary side elevational view of a third embodiment of the arbor adaptor and blade hereof, showing the use of a deep head retaining bolt received in a complementally configured hexagonal recess, and a radially oriented pin hole in the outer margin of the arbor adaptor for receiving a pin-type wrench, shown in phantom.

FIGS. 5 and 6 illustrate a third embodiment of the present invention including arbor adaptor 124 and blade 126. Blade 126 is substantially identical to blade 22 with like reference numbers used to show features common to both blade 22 and 126. Arbor adaptor 124 may be used in conjunction with arbor 64 and is similar to arbor adaptor 24, except for two particular features described below. The arbor adaptor 124 includes a hexagonal socket 128 on at least one of the first engagement side 40 and second engagement side 42 centered on axis A. The hexagonal socket 128 is of sufficient depth to receive a complementally sized head 130 of a retaining bolt 18A. The retaining bolt 18A is substantially identical to the retaining bolt 18, but may be provided with a head 130 of somewhat greater depth, thereby permitting the head 130 to fit into the socket 128 and to extend therefrom a sufficient distance to provide good engagement with a wrench, such as a socket wrench 132 shown in phantom in FIG. 7. Because of the fitting engagement between the head 130 of the retaining bolt 18A and the socket 128, rotation of the retaining bolt 18A causes corresponding rotation of the arbor adaptor 124, thereby tightening the arbor adaptor 124 to hold the blade 126 in gripping frictional engagement against the arbor 14.

Figure 7:
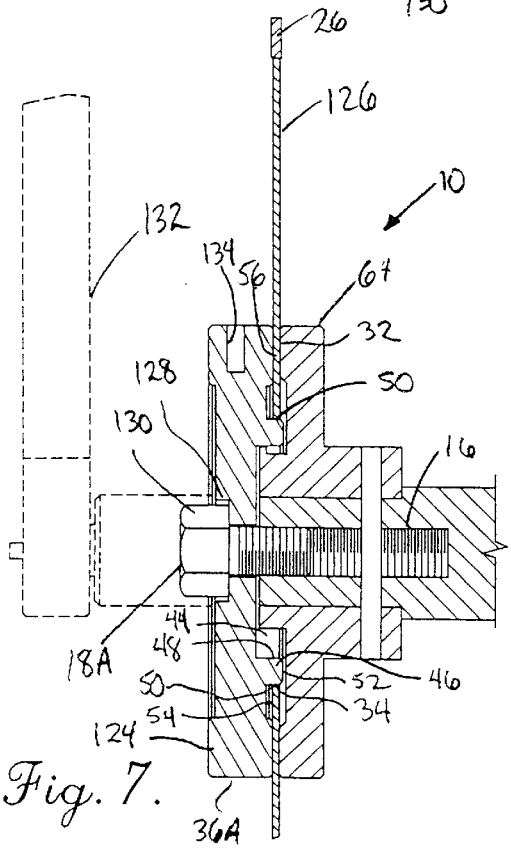
FIG. 7 is a fragmentary vertical cross-sectional view taken along line 7—7 of FIG. 6 and similar to FIGS. 2, 3 and 5, showing, in phantom, the use of a socket wrench to tighten the arbor adaptor for holding the blade against the arbor.
Figure 8:
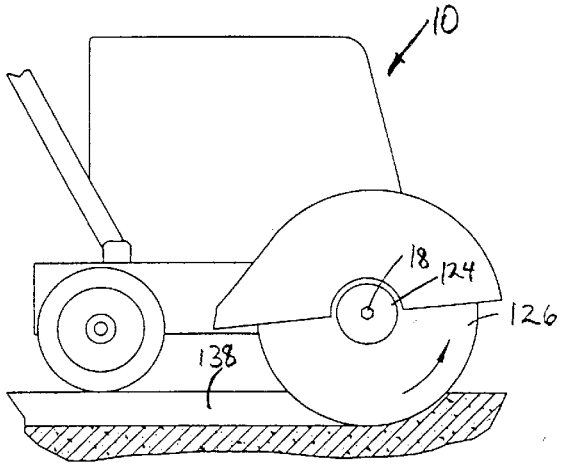
FIG. 8 is a diagrammatic view showing the direction of the blade during rotation when in use with a concrete cutting saw.

The arbor adaptor 124 has another means of tightening and loosening the arbor adaptor 124 against the blade by the provision of a pin hole 134 on the outer margin 36A. A pin type wrench 136 having a pin 138 fitting into a radially oriented pin hole 134 may be used to rotate and tighten the arbor adaptor 124 in a clockwise direction as shown in FIG. 7. That is, pin hole 134 has a generally radially oriented axis, whereby the pin 138 is inserted in a radial direction toward the central aperture and the wrench 136 wraps around the outer margin 36 so that exertion of a clockwise force on the wrench 136 tightens the arbor adaptor 124 onto the blade 126 and reversing the wrench 136 to exert a counterclockwise force tends to loosen the arbor adaptor 124 from its gripping relationship on the blade 124. As shown in FIG. 8, the saw 10 drives the blade 126 in a direction during use which tends to further tighten the blade 126 between the arbor 12 and arbor adaptor 124 as the blade 126 cuts the material 138, and thus resist slippage during use. As noted previously, the material 138 may be concrete, wood, steel or any other material typically cut with a circular saw.

In use, the blade 66 is mounted to the arbor adaptor 64 by locating the inner margin 82 over the outer rim 100 with the drive hole 80 receiving the drive pin 94. The hub 90 of the adaptor 64 is then positioned over the mounting lug 72 so that the lobes lie within the receiving areas and the engagement points 104, 106 and 108 serve to locate and center the arbor adaptor 64. The retaining bolt 18 is then inserted through the central aperture 110 and threaded onto the bore 16 of the shaft 68, whereupon the saw is ready for use. With the motor or other power source engaged and rotating the shaft 68, the mounting lug 72 rotatably drives the arbor adaptor 64 through engagement with one or more of the engagement points 104, 106 and 108, and the arbor adaptor 64 in turn rotatably drives the blade 66. The blade 66 is driven by both the frictional clamping relationship between the friction ring 32 of arbor 70 and the friction surface 96 of arbor adaptor 64 on the friction band 78 of the blade 66, and also the force imparted by the drive pin 94 to the side panel 76 of the blade 66 through the drive hole 80.

Figure 10:
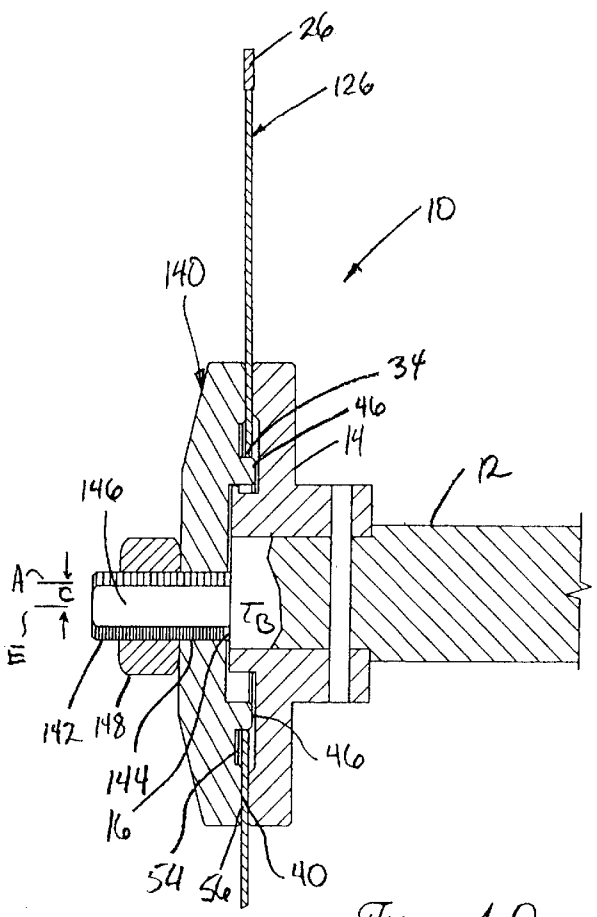
FIG. 10 is a fragmentary vertical cross-sectional view taken along line 10—of FIG. 9, and showing the arbor adaptor received on an arbor having a stud with a flattened portion of the threaded surface and offset to the axis of rotation.
Figure 9:
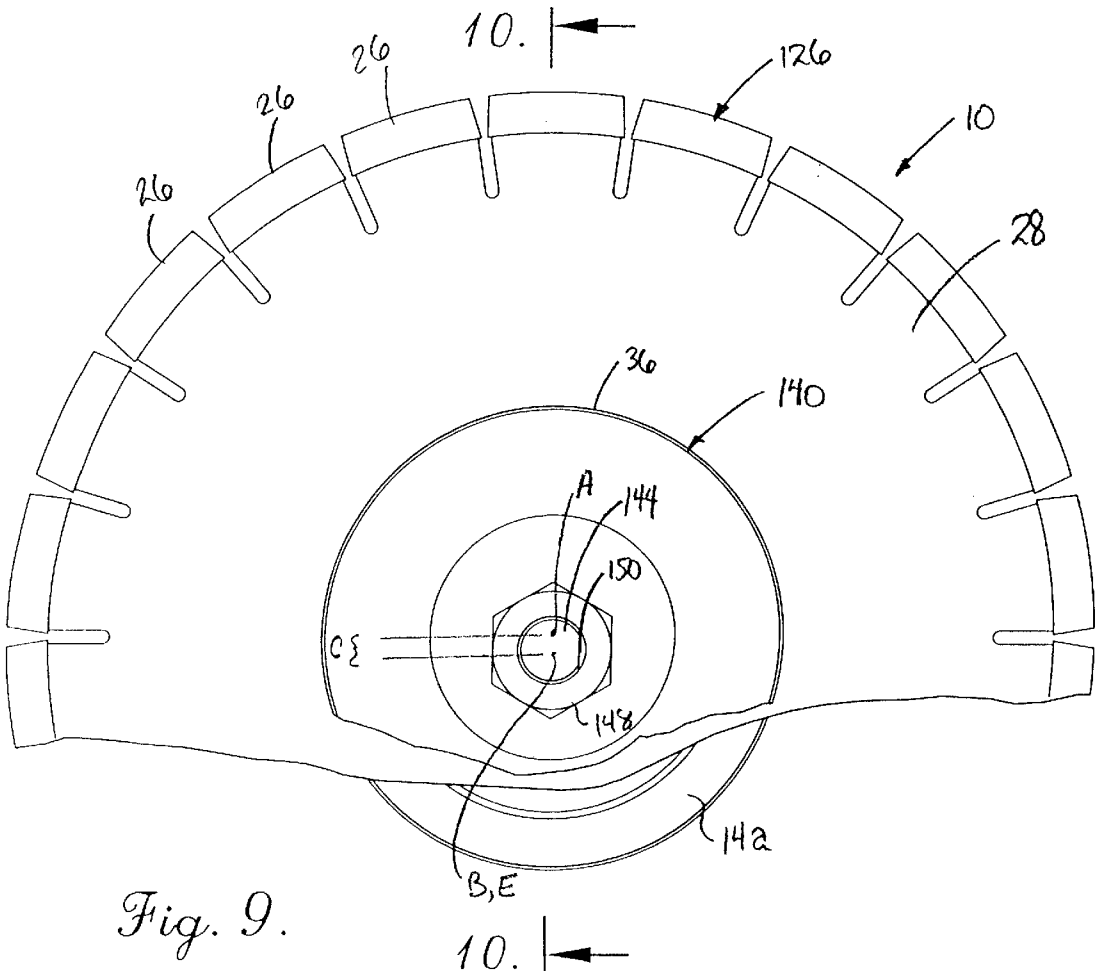
FIG. 9 is a fragmentary side elevational view of a fourth embodiment of the arbor adaptor and blade hereof for use with an arbor of a circular saw having an off-center stud.

A fourth, further embodiment of the present invention 10 is shown in FIGS. 9 and 10. The arbor adaptor 140 shown is designed for receiving thereon blade 126 as described above, having an axially centered opening with a generally circular inner margin 34 substantially equidistant from the outer edge of the teeth 26, and thus is generally statically and dynamically balanced. The arbor adapter 140 is configured for use with an arbor 14*b* which is similar to arbors 14, 14*a* or 70 described above, either including or omitting a mounting lug, except that a stud 142 is threadably mounted in the threaded central bore 16*b* of the shaft 12 or arbor 14*b*. The threaded central bore receives the stud so that the axis B of the stud 142 is offset by a displacement D a noticeable amount from the axis of rotation of the arbor A. Thus, absent compensation, mounting of a blade with a centered central opening onto a conventional mounting plate with a centered aperture would result in eccentric motion of the blade during rotation, making the blade unusable.

The arbor adaptor 140 is generally similar to the arbor adaptor 24 described above and shown in FIGS. 1–3, but further compensates for the off-centered positioning of the stud 142 by providing a central aperture 144 which has its axis E similarly offset by displacement D from the axis of rotation of the blade positioning ring 46, which is coincident with the axis of rotation A of the shaft 12. Thus, the arbor adaptor 140 is able to mount the saw blade 126 on its blade positioning ring 46 as described above. The mass of the arbor adaptor is sufficient to overcome the slight imbalance caused by the displacement D of the central aperture from the axis of rotation at the operating speeds of rotation. Thus, the arbor 14*a*, arbor adaptor 140, and blade 126 effectively spin about the axis of rotation A. The stud 142 may have a flat surface 146 along one side thereof but nonetheless be able to threadably receive thereon a nut 148. Beneficially, the central aperture 144 is D-shaped so as to be complemental to the shape, size and orientation of the stud 142. The corresponding flat side 150 of the D-shaped central aperture 144 thus aids in locating the arbor adaptor on the stud 142 and resists shifting of the arbor adaptor to an off-centered position during rotation. Operation of the saw after mounting of the blade and adaptor 140 onto the stud is then conventional as described above and generally known to those skilled in the art.

In each of the embodiments, the blade may be provided with a simple, non-specific center opening which is preferably circular, but in any event the inner margin is sufficiently great to avoid engagement with the arbor in a driven relationship. The blade is instead driven by either friction because of the sandwich-type clamping between the arbor and the arbor adapter, or the combination of the aforementioned clamping and the drive pin on the arbor adapter. Thus, greater savings to the user can be expected by the ability to provide a single arbor adapter and blade which can be used with different saws, and by a single blade generic to several saws rather than a specific blade capable of use with only one saw. The provision of the raised blade positioning ring enables the arbor adapter and a non-specific blade to be used with saws having special configuration arbors by providing proper blade alignment without interfering with their operation or the necessity of modification to the saw.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. As one example, FIG. 8 illustrates the circular saw 10 as being wheeled, but it is to be understood that hand-held, fixed or mounted circular saws may all employ the arbor adapter and blade hereof.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. An arbor adaptor for mounting a blade to a circular saw, said arbor adaptor comprising:

a body including an aperture adapted to receive a fastener for mounting to a saw therethrough; and a first engagement side on the body including a central recess, a friction surface for clamping a blade to a saw, said friction surface being spaced radially outward from said central recess and extending normally outwardly from said recess, and a blade positioning ring configured to removably receive a succession of respective saw blades thereon and located radially intermediate said central recess and said friction surface and having a substantially centrally positioned axis of rotation, said blade positioning ring including a inner rim extending substantially normal to said central recess and an outer rim which is substantially normal to said friction surface and is substantially circular, said blade positioning ring extending normally from said central recess a greater distance than said friction surface, wherein the blade positioning ring has an axis of rotation centrally located on the arbor adaptor and the aperture has an axis which is offset from and displaced relative to the axis of rotation of the blade positioning ring.

2. The arbor adaptor according to claim 1, wherein said first engagement side further includes an annular relief recess located radially between said blade positioning ring and said friction surface.

3. The arbor adaptor according to claim 2, wherein said annular relief recess is depressed relative to said blade positioning ring and said friction surface.

4. The arbor adaptor according to claim 3, wherein said central recess is depressed relative to said annular relief recess.

5. The arbor adaptor according to claim 4, wherein said inner rim is substantially circular.

6. The arbor adaptor according to claim 4, wherein said inner rim has an irregular configuration.

7. The arbor adaptor according to claim 4, including a drive pin positioned in said relief recess inwardly of said friction surface and extending substantially normally from said relief recess farther than said friction surface.

8. The arbor adaptor according to claim 4, wherein said central recess has a first diameter and said friction surface is annular and has a radial dimension, and wherein said arbor adaptor includes a second engagement side opposite said first engagement side, said second engagement side including a second central recessed area having a substantially different diameter the diameter of the recessed area of said first engagement side, and a second friction surface opposite to and having substantially the same radial dimension as the friction surface of said first engagement side.

9. In a circular saw having a rotatably driven shaft carrying an arbor and having a retaining fastener, the improvement comprising:

a blade presenting a substantially circular inner margin defining an arbor-receiving opening; and an arbor adaptor including a central aperture and a first engagement side, said first engagement side including a central recess, a friction surface for cooperating with said arbor to clamp said blade therebetween and spaced radially outward from said central recess and extending normally outwardly from said recess, and a blade positioning ring located radially intermediate said central recess and said friction surface, said blade positioning ring including a inner rim extending substantially normal to said central recess and an outer rim which is substantially normal to said friction surface and circular for receiving said substantially circular inner margin therearound.

10. The saw according to claim 9, wherein said blade positioning ring extends generally perpendicularly from said central recess a greater distance than said friction surface.

11. The saw according to claim 10, wherein said first engagement side further includes an annular relief recess located radially between said blade positioning ring and said friction surface.

12. The saw according to claim 11, wherein said annular relief recess is depressed relative to said blade positioning ring and said friction surface.

13. The saw according to claim 12, wherein said central recess is depressed relative to said annular relief recess.

14. The saw according to claim 13, wherein said inner rim is substantially circular.

15. The saw according to claim 13, wherein said inner rim has an irregular configuration.

16. The saw according to claim 13, including a drive pin positioned in said relief recess inwardly of said friction surface and extending substantially normally from said relief recess farther than said friction surface.

17. The saw according to claim 16, wherein said blade includes a drive hole complementally configured and positioned to receive said drive pin therein.

18. The saw according to claim 13, wherein said central recess has a first diameter and said friction surface is annular and has a radial dimension, and wherein said arbor adaptor includes a second engagement side opposite said first engagement side, said second engagement side including a second central recessed area having a substantially different diameter the diameter of the recessed area of said first engagement side, and a second friction surface opposite to and having substantially the same radial dimension as the friction surface of said first engagement side.

19. The saw according to claim 1, wherein said shaft has an axis of rotation and said fastener is operatively coupled to said shaft so as to be offset to the axis of rotation of the shaft by a displacement, and wherein said blade positioning ring has an axis of rotation coincident to the axis of rotation of the shaft. and wherein said central aperture of said arbor adaptor is offset by said displacement from the axis of the blade positioning ring whereby said blade mounted on the blade positioning ring rotates in a substantially circular, non-eccentric motion during rotation of the shaft.

20. An arbor adapter for mounting a blade to a circular saw, said arbor adapter comprising:

a body including an aperture unthreaded throughout its length adapted to receive a fastener for mounting to a saw through said aperture, said aperture having an axial extent; and a first engagement side on the body including a central recess, a friction surface for clamping a blade to a saw, said friction surface being spaced radially outward from said central recess and extending normally outwardly relative to said recess, a blade positioning ring configured to removably receive a succession of respective saw blades thereon and located radially intermediate said central recess and said friction surface and having a substantially centrally positioned axis of rotation, said blade positioning ring including a inner rim extending substantially normal to and at least partially defining said central recess and an outer rim which is substantially normal to said friction surface and is substantially circular, said inner rim having a diameter which is more than twice the axial extent of said aperture, said blade positioning ring extending normally from said central recess a greater distance than said friction surface, and an annular relief recess located radially between said blade positioning ring and said friction surface and wherein said annular relief recess is depressed relative to said blade positioning ring and said friction surface but wherein said central recess is depressed relative to said annular relief recess.

21. The arbor adaptor according to claim 20, further including a socket recess axially aligned with said aperture and located opposite said first engagement side and presenting a substantially hexagonal configuration.

22. The arbor adaptor according to claim 20, further including an outer margin, said outer margin including a radially oriented hole therein.

23. The arbor adaptor according to claim 20, wherein the blade positioning ring has an axis of rotation centrally located on the arbor adaptor and the aperture is centrally located and has an axis coincident with the axis of rotation of the blade positioning ring.

24. The arbor adaptor according to claim 20, wherein the blade positioning ring has an axis of rotation centrally located on the arbor adaptor and the aperture has an axis which is offset from and displaced relative to the axis of rotation of the blade positioning ring.

25. The arbor adaptor according to claim 24, wherein the central aperture is D-shaped.

26. An arbor adaptor for mounting a blade to a circular saw, said arbor adaptor comprising:

a body including an aperture unthreaded throughout its length adapted to receive a fastener for mounting to a saw through said aperture, said aperture having an axial extent; and a first engagement side on the body including a central recess, a friction surface for clamping a blade to a saw, said friction surface being spaced radially outward from said central recess and extending normally outwardly from said recess, and a blade positioning ring configured to removably receive a succession of saw blades thereon and located radially intermediate said central recess and said friction surface and having a substantially centrally positioned axis of rotation, said blade positioning ring including a inner rim extending substantially normal to said central recess and an outer rim which is substantially normal to said friction surface and is substantially circular, said blade positioning ring extending normally from said central recess a greater distance than said friction surface.

* * * * *